United States Patent [19]

Hoet

[11] Patent Number: 4,728,852

[45] Date of Patent: Mar. 1, 1988

[54] DEVICE FOR FIXING A PYROLYTIC GRAPHITE GRID ONTO THE BASE OF AN ELECTRON TUBE

[75] Inventor: Roger Hoet, Thonon les Bains, France

[73] Assignee: Thomson-CSF, Paris, France

[21] Appl. No.: 748,544

[22] Filed: Jun. 25, 1985

[30] Foreign Application Priority Data

Jun. 29, 1984 [FR] France ..... 8410357

[51] Int. Cl.[4] ..... H01J 1/46

[52] U.S. Cl. ..... 313/348; 313/341; 313/343; 313/349

[58] Field of Search ..... 313/341, 348, 343, 349, 313/272, 296, 299

[56] References Cited

U.S. PATENT DOCUMENTS 4,119,880 10/1978 Wilcox ..... 313/341

*Primary Examiner*—Leo H. Boudreau
*Assistant Examiner*—Michael Razavi
*Attorney, Agent, or Firm*—Roland Plottel

[57] ABSTRACT

The present invention concerns a device for fixing the skirt of a grid made of pyrolytic graphite to the base of an electron tube, the fixation device being constituted by a ring fixed onto the base of the tube against which is maintained the skirt of the grid by means of abutments.

2 Claims, 3 Drawing Figures

FIG_1
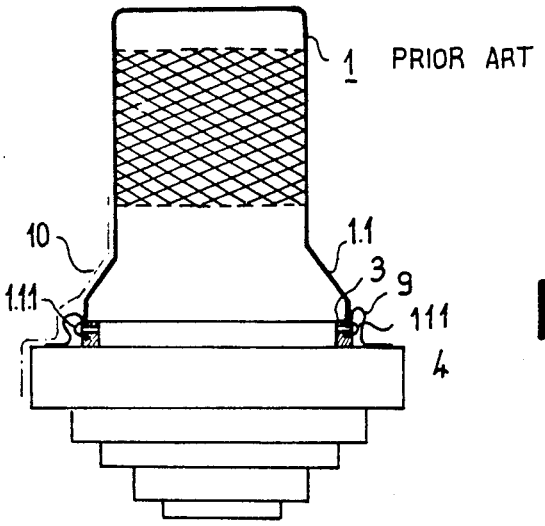
FIG_2
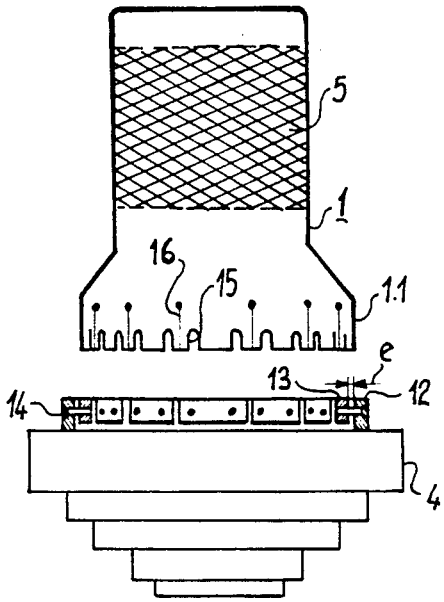
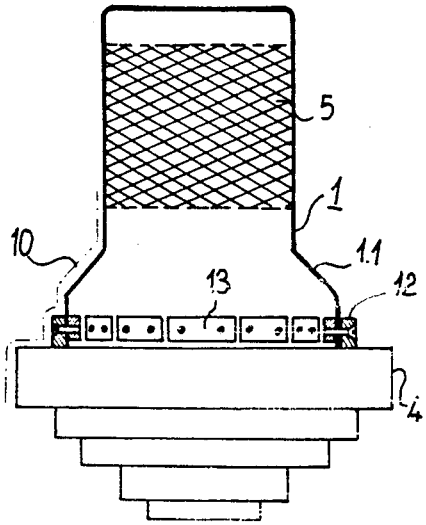
FIG_3

DEVICE FOR FIXING A PYROLYTIC GRAPHITE GRID ONTO THE BASE OF AN ELECTRON TUBE

BACKGROUND OF THE INVENTION

The present invention concerns electron tubes comprising at least one grid made of pyrolytic graphite. It concerns, more particularly, a device for fixing the grid onto the base of an electronic tube.

DESCRIPTION OF THE PRIOR ART

The advantages inherent in the grids made of pyrolitic graphite are well known. These grids, which have been used in a wide range of industrial applications by the applicant, are generally realized in the form of cylindrical bells with thin walls the base, also called skirt, of which is fixed onto the metallic base of the tube.

However, the utilization of pyrolytic graphic raises a certain number of problems with respect to the mounting and fixation of the grid onto the base.

In fact, the mounting and the fixation of the grid onto the base have to satisfy simultaneously at least three requirements, namely:

high accuracy and great geometric deformability in order to guarantee the precision and the constancy of the cathode-grid spacing upon which depends the perveance;

flexible absorption without alignment defect, of the dilatation gap of the graphite and the metal of the base;

passage of the current without high frequency loss.

Different solutions have been proposed in order to overcome these problems.

The oldest solution, represented in FIG. 1, consists in fixing the skirt 1.1 of the grid 1 onto a metallic flange 3, integral with the base 4 of the tube through the intermediary of screws 1.1.1 or bolts. However, this type of fixation presents a high resistance to the passage of the high frequency current 10 flowing at the external surface of the grid. Therefore, in order to reduce the losses caused by the resistance to the high frequency current during passage, it is necessary to displace the screws 1.1.1 by metallic strips 9 that pass under the screw heads and are electrically welded onto the base 4. In this case, the fixation of the grid onto the base lasts long time.

In order to reduce the resistance during passage of the high frequency current, French Pat. No. 78.29922 published under No. 2 439 474 proposes modifying the skirt of the grid by realizing in this section a network of slots and holes and overmoulding on it a pure metal or alloy that does not diffuse in the graphite.

It has been proposed in French patent application No. 81 23739 to provide the end of the skirt of the grid with a metal support or bracket constituted by two rings assembled concentrically on the end of the skirt of the grid by soldering, the bracket being thereafter fixed onto the base of the tube.

However, the devices disclosed herein-above present, during their obtention, difficulties of technological reduction to practice and require very long manufacturing time, thereby increasing the manufacturing costs of the electronic tube.

SUMMARY OF THE INVENTION

The present invention therefore has the aim of overcoming the drawbacks described herein-above by providing a device for fixing or securing the pyrolytic graphite grid offering good heat stability and electrical properties, allowing especially to reduce the resistance to the high frequency current during its passage.

The present invention also has the aim of providing a device for fixing the pyrolytic graphite grid onto the metallic base of an electron tube which has a simple form and application with respect to the devices of the prior art.

Therefore, the aim of the present invention is to obtain a fixation device for the skirt of a pyrolytic graphite grid onto the base of an electronic tube, wherein it is constituted by a ring fixed onto the base of the tube against which is maintained the skirt of the grid by at least one abutment.

BRIEF DESCRIPTION OF THE DRAWINGS

Other features, objects and advantages of the present invention will become apparent from reading the following description of a preferred embodiment, given with reference to the appended drawings, in which:

FIG. 1 already described, is a schematic axial cross-section of a pyrolytic graphite grid fixed onto the base of an electronic tube according to the prior art;

FIG. 2 is a schematic axial cross-section view of the fixation device according to the invention prior to assembling; and FIG. 3 is a view identical to that of FIG. 2 once the assembly has been achieved.

DESCRIPTION OF THE PREFERRED EMBODIMENTS

On FIGS. 2 and 3, the grid 1, made of pyrolytic graphite, has the form of a cylindrical bell having a useful portion 5, i.e. a part located in the path of the electrons, which is machined in order to form a criss-cross, for example, by sand blasting. This useful portion 5 is extended by a full cylindrical sleeve 1.1, often called a skirt. By the skirt 1.1 the electron tube can be fixed in a base 4.

According to the present invention, the lower end of the skirt 1.1 is provided, on its periphery, with recesses 15 that allow the mounting of the grid upon the fixation device, as will be explained in further detail hereinbelow.

As represented in FIG. 2, the fixation device is mainly constituted by an outer ring 12 and by several separate abutments 13 forming a segmented inner ring concentric to the ring 12. The ring 12 which is preferably made of a metal such as copper, molybdenum or an iron-nickel-cobalt alloy, is soldered onto the base 4 of the electron tube.

Furthermore, the abutments 13 are preferably made of a metal such as copper molybdenum, or an iron-nickel-cobalt alloy or similar, and are fixed onto the ring 12 by means of screws 14 or bolts, by providing between the abutments 13 and the ring 12 an interval e slightly greater than the thickness of the skirt. According to one preferred embodiment, the abutments 13 can be obtained from a ring the external diameter of which is substantially equal to the internal diameter of the lower end of the skirt. This ring is obtained, for example, through moulding under vacuum when it is made of copper and by machining by core drilling. After having been provided with vacancies, this ring is thereafter segmented by sawing or by milling, in order to form abutments 13.

In order to achieve the mounting of the grid 1 on the base 4, after having soldered the ring onto the base, the abutments are first of all fixed onto the ring as described herein-above, the the grid 1 is vertically embedded upon the base 4, the recesses 15 surrounding the screws 14. It is thus possible to achieve the clamping of the end of the skirt 1.1 between the ring 12 and the internal abutments 13, as represented on FIG. 3.

Preferably, in order to obtain a correct adjustment of the inside of the ring 12 and of the abutments 13, the outside and the inside the skirt 1.1 are precision machined.

With this fixation device, an external contact is ensured by the ring 12 over the whole surface of the grid, without interruption. The resistance to the passage of the high frequency current 10 is thus improved.

Furthermore, the heat conductibility between the grid and the base 4 is thus improved.

This point is very important since the losses due to the high frequency current increase with the temperature.

Similarly, in order to compensate the differences of dilation between the graphite skirt and the metallic base, it is possible to realize, by sawing or by machining on the peripheric of the skirt 1.1 a series of dilation recesses 16.

Modifications may be made to the embodiment described herein-above, without departing from the scope and spirit of the present invention defined by the claim. It is possible to envisage, in particular, providing an internal ring and external abutments. In this case, however, the external contact is ensured by with interruptions.

I claim:

1. A high frequency electron tube having at least one grid of pyrolytic graphite having a skirt portion which is fixed to the base of the electron tube comprising a first continuous metallic outer ring integral with the base of the electron tube, a plurality of separated metallic abutments for defining an inner segmented ring concentric with and spaced apart from the outer ring by a distance essentially equal to the thickness of the skirt portion of the grid, and means for fixing the inner ring to the outer ring, the skirt portion of the grid being fitted in the space between the inner and outer rings and being provided with recesses for passage therethrough of the means for fixing the inner ring to the outer ring, said fixing means and bolts passing between said inner ring and outer ring through recesses in the skirt portions, and in which the abutments forming the inner ring are spaced from the base of the electron tube.

2. A high frequency tube in accordance with claim 1 in which at least one of the inner or outer rings is of a metal chosen from the groups consisting of copper, molybdenum or an iron-nickel-cobalt alloy.

* * * * *